US011215354B1

(12) United States Patent
Descher

(10) Patent No.: US 11,215,354 B1
(45) Date of Patent: Jan. 4, 2022

(54) DEVICES AND APPARATUSES FOR ENHANCING FRUITS AND VEGETABLES

(71) Applicant: Joseph Zeno Descher, Bixby, OK (US)

(72) Inventor: Joseph Zeno Descher, Bixby, OK (US)

( * ) Notice: Subject to any disclaimer, the term of this patent is extended or adjusted under 35 U.S.C. 154(b) by 100 days.

(21) Appl. No.: 14/469,548

(22) Filed: Aug. 26, 2014

(51) Int. Cl.
*F21V 35/00* (2006.01)
*F21W 121/00* (2006.01)
*F21Y 103/00* (2016.01)

(52) U.S. Cl.
CPC ..... *F21V 35/006* (2013.01); *F21W 2121/00* (2013.01); *F21Y 2103/003* (2013.01)

(58) Field of Classification Search
CPC . A63H 3/365; F21Y 2115/10; F21Y 2107/00; F21Y 2105/00; F21Y 2115/15; F21Y 2113/13; F21Y 2115/20; F21Y 2103/10; F21Y 2105/10; F21Y 2105/12; F21Y 2107/60; F21W 2121/00; F21W 2121/004; F21W 2121/006; F21W 2121/02; F21W 2121/04; H01K 7/06; H01K 1/24; H01K 1/28; H01K 3/06; H01K 5/02; F23D 3/16; F23D 3/24; F21V 35/00; A45F 5/00; A45F 2005/008; A45F 2200/0591; A45F 5/02; A45F 2200/0516; A45F 2200/055; A45F 2005/006; A45F 2200/0583; A45F 5/004; A45F 5/021; A45F 2003/146; A45F 2005/023; A45F 2200/0566; A45F 2200/0575; A45F 3/06; A45F 3/16; A45F 5/102; B26B 11/008; B26B 11/00; B26B 1/10; B26B 5/001; B26B 5/003; B26B 9/00; B26B 11/001; B26B 1/02; B26B 27/00; B26B 3/00; B26B 3/06
See application file for complete search history.

(56) References Cited

U.S. PATENT DOCUMENTS 3,767,355 A * 10/1973 Anderson, Jr. ..... A47G 7/07 431/295
4,751,621 A * 6/1988 Jenkins ..... B26B 11/008 362/119
5,091,833 A * 2/1992 Paniaguas ..... A63H 3/365 362/191
5,957,566 A * 9/1999 Chiu ..... F21L 15/02 362/186
6,342,175 B1 * 1/2002 Brown ..... A47J 25/00 264/155
7,862,397 B1 * 1/2011 Ng ..... A63H 29/16 40/411
2005/0248952 A1 * 11/2005 Yao ..... F21S 6/001 362/392

(Continued)

OTHER PUBLICATIONS

Halloween Flashlights—5 Minute DIY Craft, https://web.archive.org/web/20140209144603/https://mesewcrazy.com/2013/10/halloween-flashlights-5-minute-diy-craft.html (Feb. 9, 2014).*

*Primary Examiner* — Jason Lau
(74) *Attorney, Agent, or Firm* — John M. Behles

(57) ABSTRACT

Devices and apparatuses for enhancing fruits and vegetables are provided herein. In one embodiment a device includes a cover body having a decorative aperture and a tubular collar formed proximate an outer peripheral edge of the cover body, the tubular collar extending away from the cover body, the tubular collar having a terminal edge surface and a length that extends along a central axis of the cover body.

6 Claims, 9 Drawing Sheets

(56) References Cited

U.S. PATENT DOCUMENTS

| | | | | |
|---|---|---|---|---|
| 2006/0099540 | A1* | 5/2006 | Avelar | F21S 13/00<br>431/35 |
| 2013/0016501 | A1* | 1/2013 | Zinox | F21V 33/00<br>362/183 |

* cited by examiner

DEVICES AND APPARATUSES FOR ENHANCING FRUITS AND VEGETABLES

CROSS REFERENCE TO RELATED APPLICATIONS

N/A

FIELD OF THE PRESENT TECHNOLOGY

The present technology relates generally to devices and apparatuses that enhance decorative fruits and vegetables, such as pumpkins and gourds. More specifically, but not by limitation, the present technology contemplates devices and apparatuses that are used to mimic stencils and stencil cutouts used to create cutout patterns in, for example, pumpkins and gourds.

SUMMARY OF THE PRESENT TECHNOLOGY

According to some embodiments, the present technology may be directed to a device, comprising: (a) a cover body having a decorative aperture; and (b) a tubular collar formed proximate an outer peripheral edge of the cover body, the tubular collar extending away from the cover body, the tubular collar having a terminal edge surface and a length that extends along a central axis of the cover body.

In one embodiment, the device further comprises a cutting member associated with the terminal edge surface.

In another embodiment, the device further comprises a light source associated with a back surface of the cover body, the light source being covered by tubular collar.

In yet another embodiment, the device further comprises a colored lens that covers at least a portion of the decorative aperture.

In one embodiment, the tubular collar is releasably connected to the cover body.

In yet another embodiment, the colored lens is disposed between the cover body and the tubular collar.

In some embodiments, the tubular collar comprises a candle holder.

According to some embodiments, the present technology may be directed to an apparatus, comprising: (a) a cover body having a decorative aperture; (b) a tubular collar formed proximate an outer peripheral edge of the cover body, the tubular collar extending away from the cover body, the tubular collar having a terminal edge surface and a length that extends along a central axis of the cover body; and (c) a cutting member associated with the terminal edge surface; and (d) a light source associated with a back surface of the cover body.

According to some embodiments, the present technology may be directed to a device, comprising a tubular length of rigid material having a first end and a second end, the first end having a cover body, the cover body comprising a patterned sidewall that forms a decorative aperture.

In one embodiment, the device further comprises a cutting member associated with a terminal edge surface of the second end.

In another embodiment, the device further comprises a light source associated with a back surface of the cover body, the light source emitting light from the decorative aperture.

In some embodiments, the device further comprises a colored lens that covers at least a portion of the decorative aperture, and the wherein the colored lens is disposed between the cover body and the tubular length of rigid material.

BRIEF DESCRIPTION OF THE DRAWINGS

Certain embodiments of the present technology are illustrated by the accompanying figures. It will be understood that the figures are not necessarily to scale and that details not necessary for an understanding of the technology or that render other details difficult to perceive may be omitted. It will be understood that the technology is not necessarily limited to the particular embodiments illustrated herein.

DESCRIPTION OF EXEMPLARY EMBODIMENTS

Figure 1:
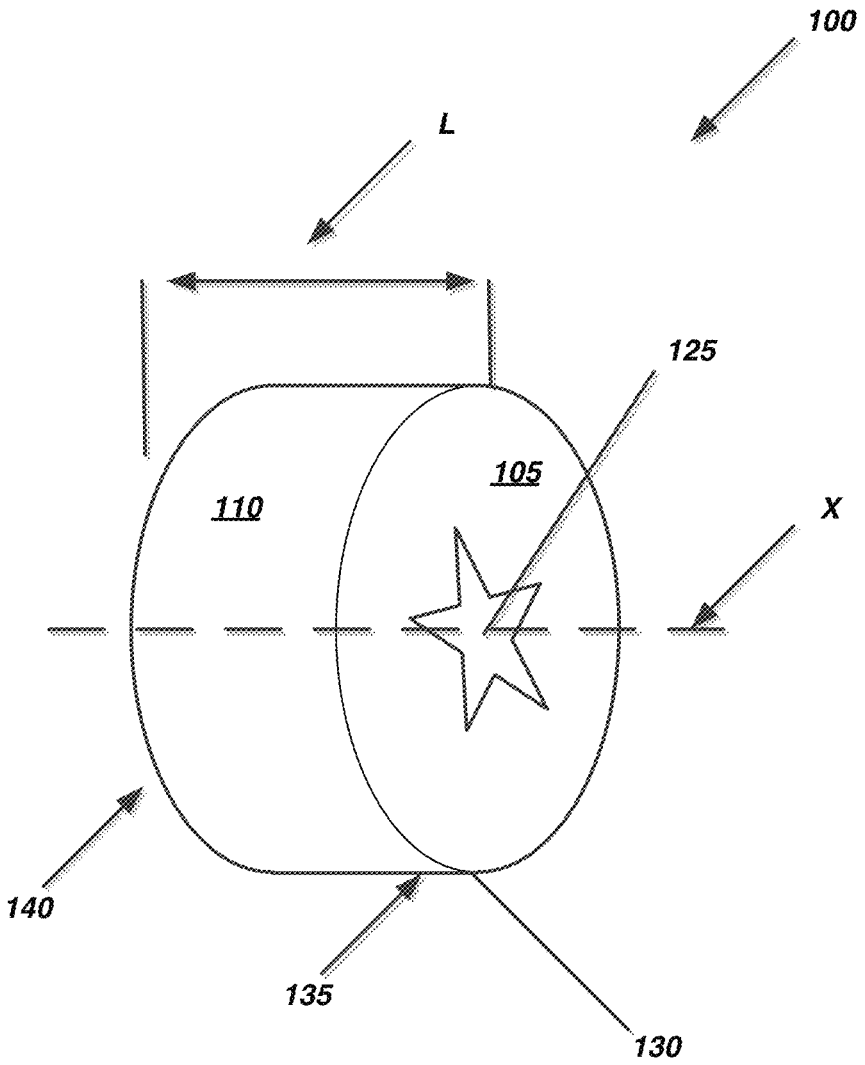
FIG. 1 is a perspective view of an example device, constructed in accordance with the present technology.

While this technology is susceptible of embodiment in many different forms, there is shown in the drawings and will herein be described in detail several specific embodiments with the understanding that the present disclosure is to be considered as an exemplification of the principles of the technology and is not intended to limit the technology to the embodiments illustrated.

The terminology used herein is for the purpose of describing particular embodiments only and is not intended to be limiting of the present technology. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that like or analogous elements and/or components, referred to herein, may be identified throughout the drawings with like reference characters. It will be further understood that several of the figures are merely schematic representations of the present technology.

As such, some of the components may have been distorted from their actual scale for pictorial clarity.

Advantageously, the present technology includes devices and apparatuses that are used to mimic stenciled cutouts in fruits and vegetables. For brevity, the following discussions will describe the present technology being used with a pumpkin. One of ordinary skill in the art will appreciate that other fruits or vegetables that can be carved or otherwise used for decorative purposes can also likewise be used in accordance with the present technology.

Paper stencils or patterns can be used to transfer a decorative pattern onto a pumpkin. After transference of the stencil pattern, the pumpkin is cutout by cutting through the outer surface and pulp of the pumpkin along the stencil pattern. The outer surface (e.g., skin) and pulp are removed to expose a decorative aperture. The inside portion of the pumpkin can be scooped out and a candle inserted into the pumpkin. Illumination of the inside of the pumpkin causes light to be projected through the decorative aperture so that the decorative aperture is seen. The decorative aperture can have any desired aesthetic shape. Because the pumpkin is a perishable item, the pumpkin deteriorates rapidly, causing the decorative aperture to shrink, deform, or otherwise lose its shape. Advantageously, the present technology includes devices and apparatuses that comprise decorative apertures that are not subject to decay, shrink, deformation, and/or shape loss. These and other advantages of the present technology will be described below with reference to the drawings.

Figure 2A:
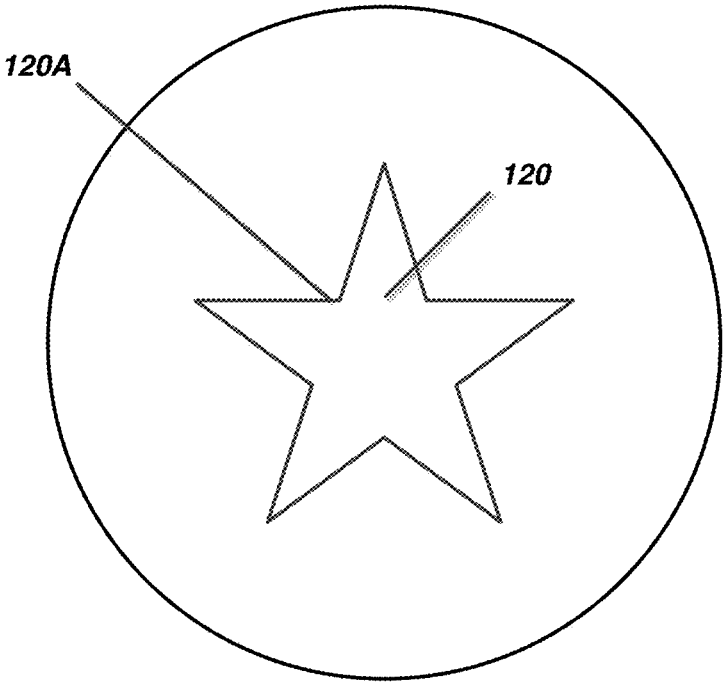
FIG. 2A is a front elevation view of the device of FIG. 1.
Figure 2B:
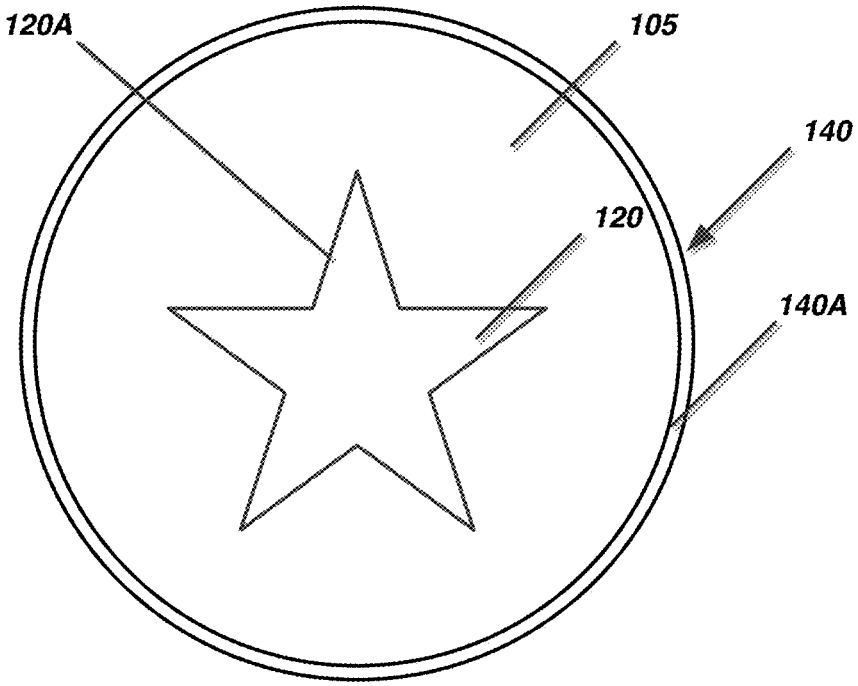
FIG. 2B is a rear elevation view of the device of FIGS. 1-2A.

FIGS. 1-2B collectively illustrate a device 100, constructed in accordance with the present technology. The device 100 generally comprises a cover body 105 and a tubular collar 110. In some embodiments, the device 100 is formed as a monolithic object. In other embodiments, the cover body 105 and the tubular collar 110 are separate components that can be joined together, as is described in greater detail in FIGS. 7A-C.

The device 100 can be manufactured from any one (or combination) of materials that can be used to create a rigid, or substantially rigid device. For example, the device 100 can be manufactured from a plastic, a polymer, a resin, a natural material, such as a hardened rubber, a composite material, a metal, an alloy, or other similar material.

The device 100 can be formed by injection molding or other thermoforming methods. In other embodiments, the device 100 or components of the device 100 such as the cover body 105 and the tubular collar 110 can be stamped, laser cut, and/or extruded. The exact manufacturing process used to create the device 100 will depend upon engineering constraints and material choice.

The cover body 105 has a thickness of material and the cover body 105 has a diameter that is sized to fit an average pumpkin. In some embodiments, the cover body 105 is preferably sized so that it does not overlap or cover the entire front surface of the pumpkin. For example, in FIG. 2, the device 105 is illustrated in an installed manner on a pumpkin 115. The device 105 is sized such that one quarter to one third of the pumpkin 115 is visible above the device 100 and one quarter to one third of the pumpkin 115 is visible below the device 100. In other embodiments, the device 100 can be sized to cover nearly all of a front surface 120 of the pumpkin 115.

Devices with differently sized disk bodies can be created. These sizes may depend upon the amount of front surface area of the pumpkin that should be covered, and/or the pumpkin type. For example, some pumpkins are tall and narrow, while others are more spherical in shape.

It will be understood that while the cover body 105 has been described, and is illustrated as substantially circular in shape, it will be understood that the cover body 105 can also include other shapes such as triangular, square, rectangular, polygonal, and irregular—just to name a few.

The cover body 105 includes a sidewall 120A that forms a decorative aperture 125. The various figures illustrate the decorative aperture 125 as being substantially star shaped. One of ordinary skill in the art will appreciate that the decorative aperture 125 can include any shape desired. For example, the decorative aperture 125 can include a pattern such as cartoon character, a word or phrase, a logo, a shape, an animal, and/or other similar shapes. Again, the decorative aperture 125 mimics a stencil pattern for the pumpkin. Because the sidewall 120A that forms the decorative aperture 125 is manufactured from a rigid or semi-rigid material that does not decay, shrink, or rot, the decorative aperture 125 remains consistent in size and shape. Advantageously, the decorative aperture 125 can include finer cuts and artistic details that would be impossible to achieve using a stencil pattern that must be cut into the pumpkin. Fine details are difficult to cut into a pumpkin because the pumpkin skin and pulp are thick and burdensome to cut precisely.

Turning to FIGS. 1 and 2B, the tubular collar 110 of the device 100 is illustrated as extending away from the cover body 105. In one embodiment, the tubular collar 110 is formed proximate an outer peripheral edge 130 of the cover body 105. The tubular collar 110 has a length L that extends along a central axis X of the cover body 105. The length L of the tubular collar 110 can vary according to design requirements.

In some embodiments, the tubular collar 110 has a first end 135 and a second end 140. The first end is proximate the covered body 105, in some embodiments. The second end 140 is open and provides a pathway from inside the pumpkin, out. The tubular collar 110 also has a thickness T that provides support to the device 100 when the tubular collar 110 is inserted into the pumpkin, or a hole cut into the pumpkin.

The second end 140 is provided with a terminal edge surface 140A.

As mentioned above with respect to the cover body 105, the tubular collar 110 while being described and illustrated as a cylindrical in shape, can also be shaped in a variety of other ways. For example, the tubular collar 110 can be shaped as a square, a triangle, or another polygon, an irregular shape, or other shape that would be known to one of ordinary skill in the art.

Figure 3A:
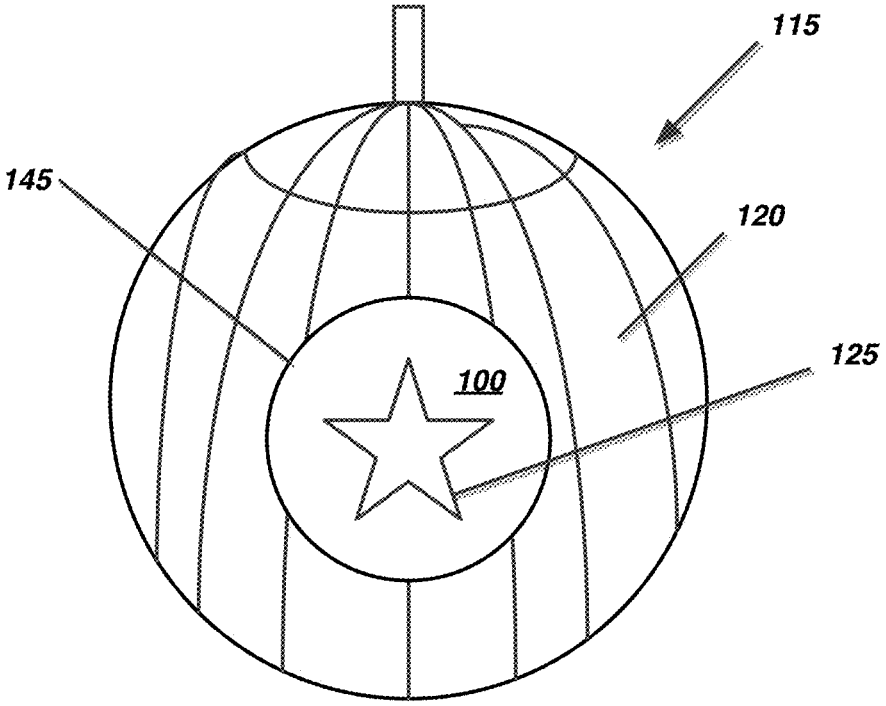
FIG. 3A is a perspective view of the device of FIGS. 1-2B installed into a pumpkin.
Figure 3B:
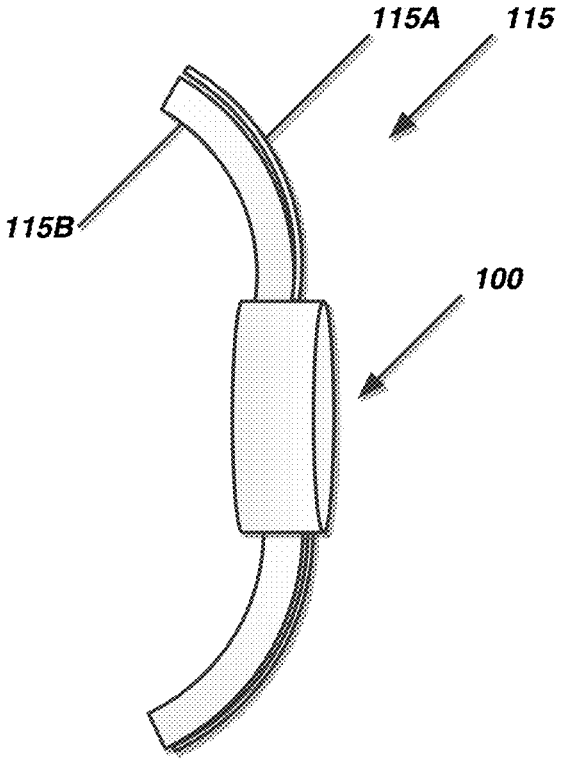
FIG. 3B is a partial cross-sectional view of the device of FIGS. 1-2B installed into a pumpkin.

Again, FIGS. 1-3B collectively illustrate the device 100, which is installed into the pumpkin 115 (FIGS. 3A and 3B). A hole 145 that is slightly larger than the diameter of the tubular collar 110 can be cut into the pumpkin 115. The tubular collar 110 is inserted into the hole 145. The tubular collar 110 can extend past the skin 115A and the pulp 115B of the pumpkin 115.

Figure 4:
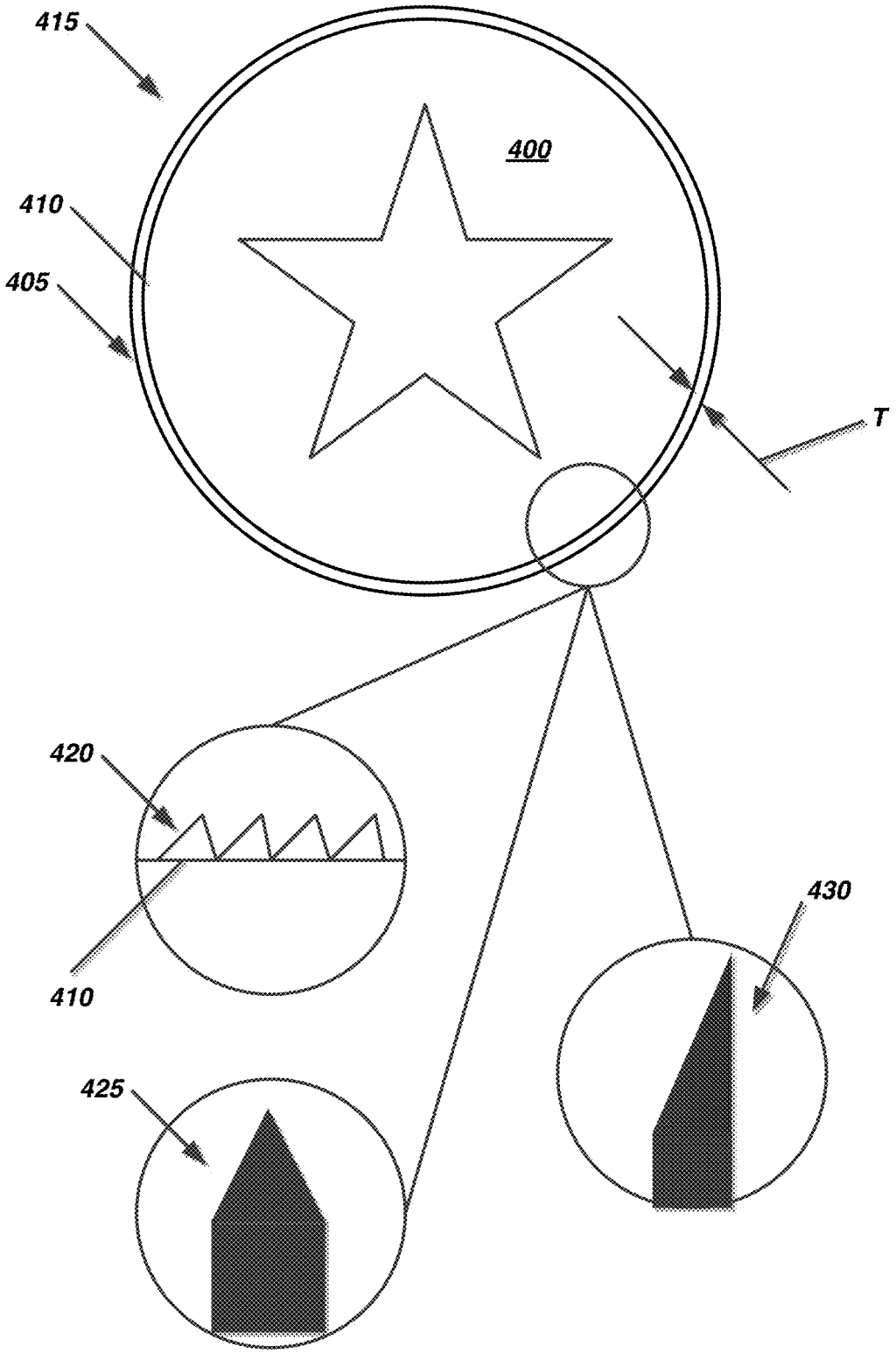
FIG. 4 is a rear elevation view of the device, with a close up view of a plurality of different cutting members of the device.

FIG. 4 illustrates an embodiment of a device 400 that is similar to the device 100 of FIGS. 1-3B with the exception that the device 400 includes a cutting member 405 that extends a terminal edge surface 410 of the tubular collar 415. The cutting member 405 can be formed into the terminal edge surface 410 or can be attached to the terminal edge surface 410. In one example, the cutting member 405 is a sawtooth cutting member 420. In another example, the cutting member 405 is a blade. In another example, the terminal edge surface 410 can be angled. FIG. 4 illustrates a blade edge 425 for the terminal edge surface 410 and an angled edge 430 for the terminal edge surface 410. In some embodiments, the thickness of the terminal edge surface 410 is sufficiently thin that the terminal edge surface 410 can pierce the skin and pulp of the pumpkin.

Figure 5:
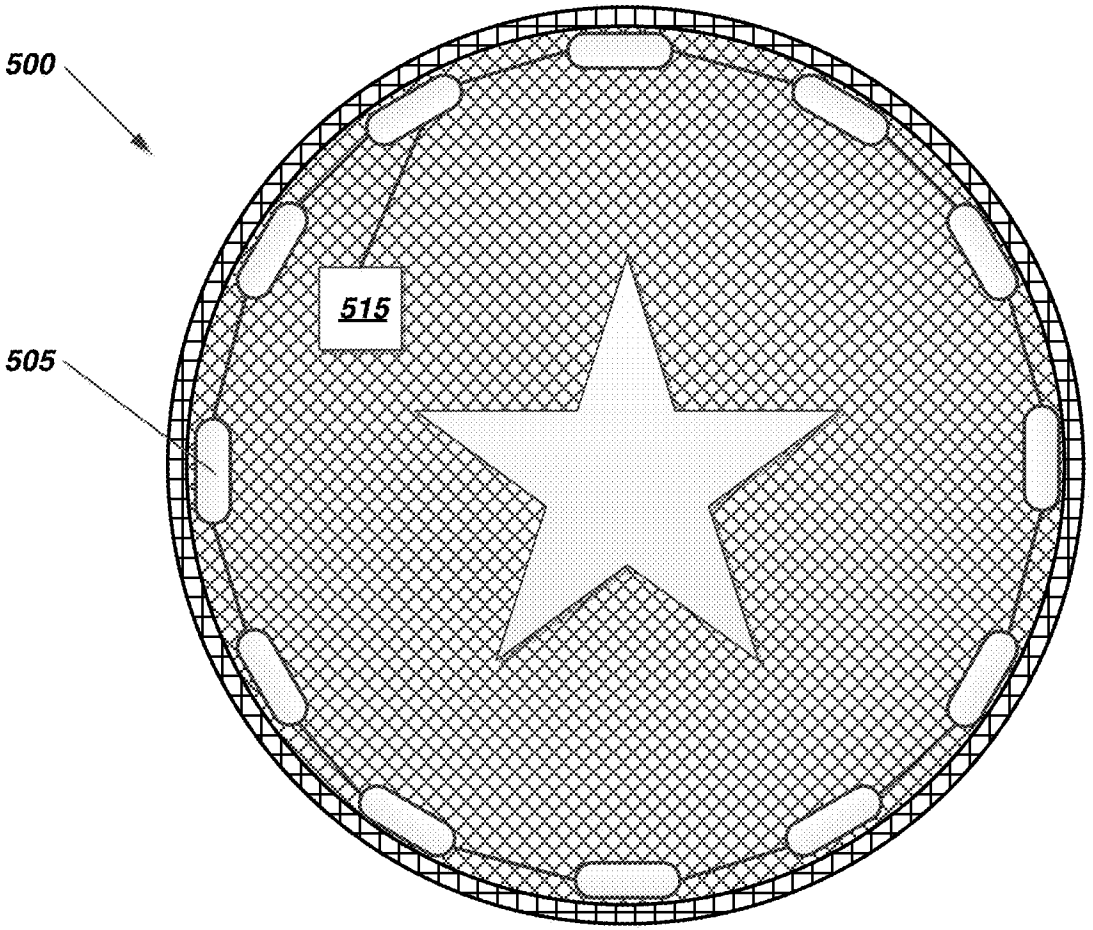
FIG. 5 is a rear elevation view of the device illustrating a light source.

FIG. 5 illustrates another example device 500 that includes light source 505. The light source 505 can be added to the devices 100 and 400 of FIGS. 1-4. The light source 505 could include a rope comprising LED (light emitting diode) lights or other similar light sources that would be known to one of ordinary skill in the art. The light source 505 can be self-contained and battery powered using a battery source 510. The light source 505 can be positioned proximate or behind a back surface 515 of the cover plate 520.

Figure 6:
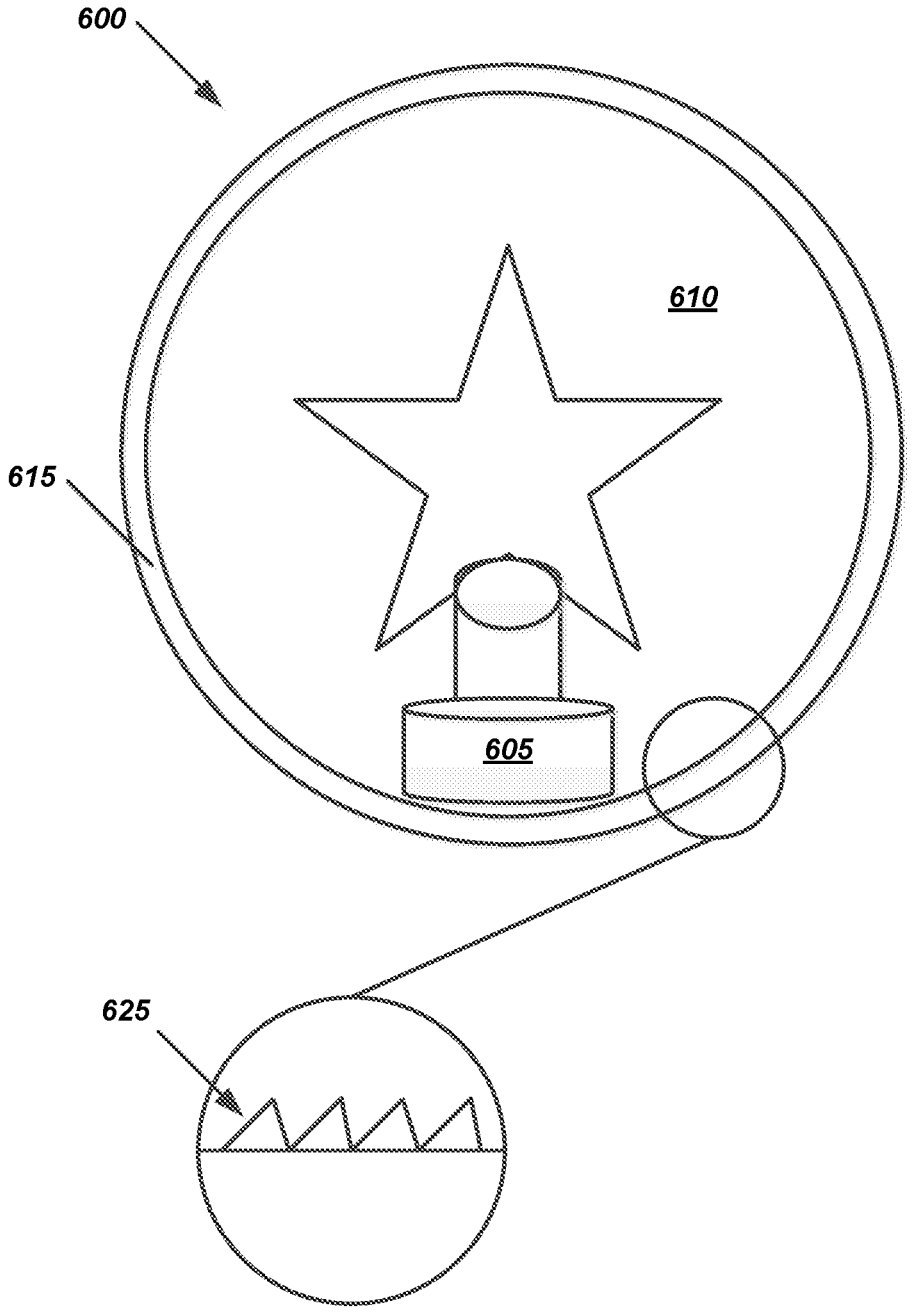
FIG. 6 is a rear elevation view of the device illustrating a candle holder.

FIG. 6 illustrates another example device 600 that includes a candle holder 605. The candle holder 605 can be associated with either the cover plate 610 or the tubular collar 615. The candle holder 605 positions a candle behind the decorative aperture 620 of the cover plate. A cutting member 625 is associated with a terminal edge surface of the tubular collar 615.

Figure 7A:
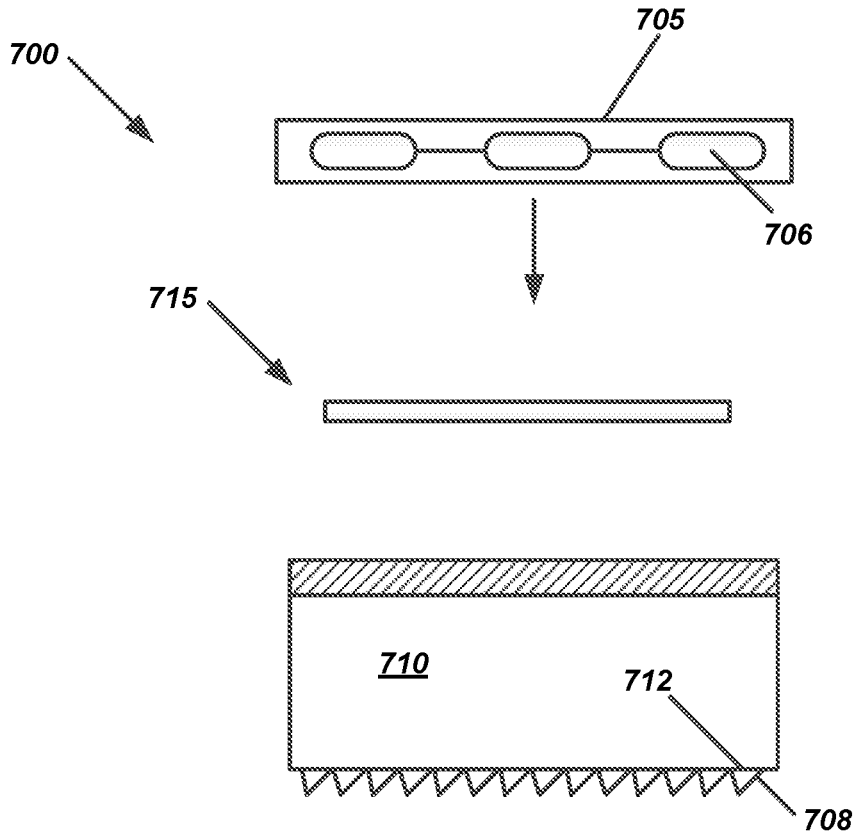
FIG. 7A is an exploded view of an apparatus that includes a cover plate, a tubular collar, and a lens.
Figure 7B:
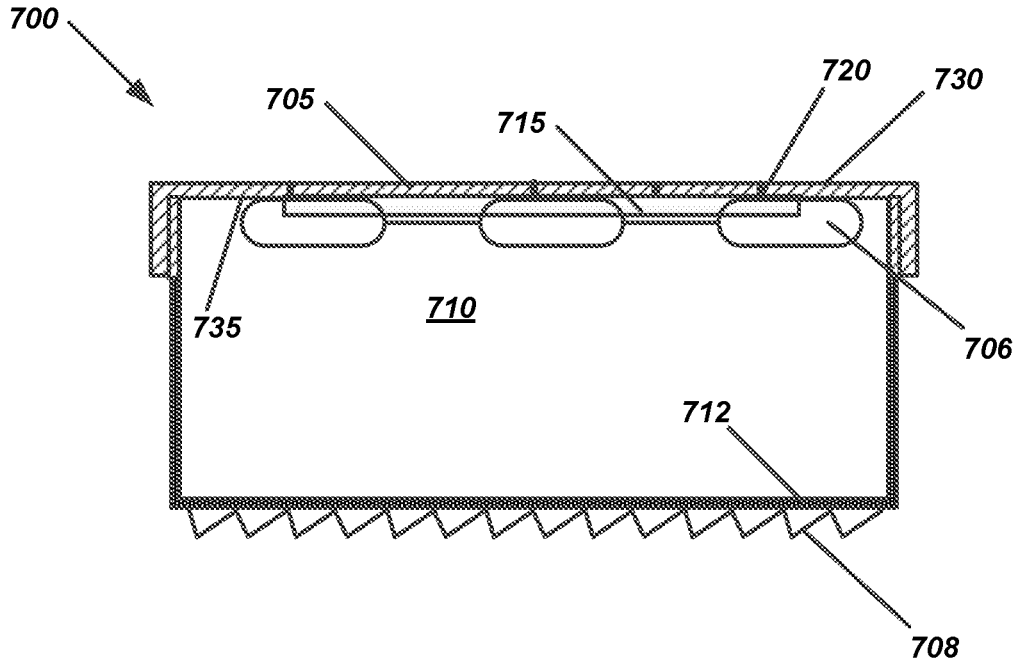
FIG. 7B is cross-sectional view of the apparatus of FIG. 7A.
Figure 7C:
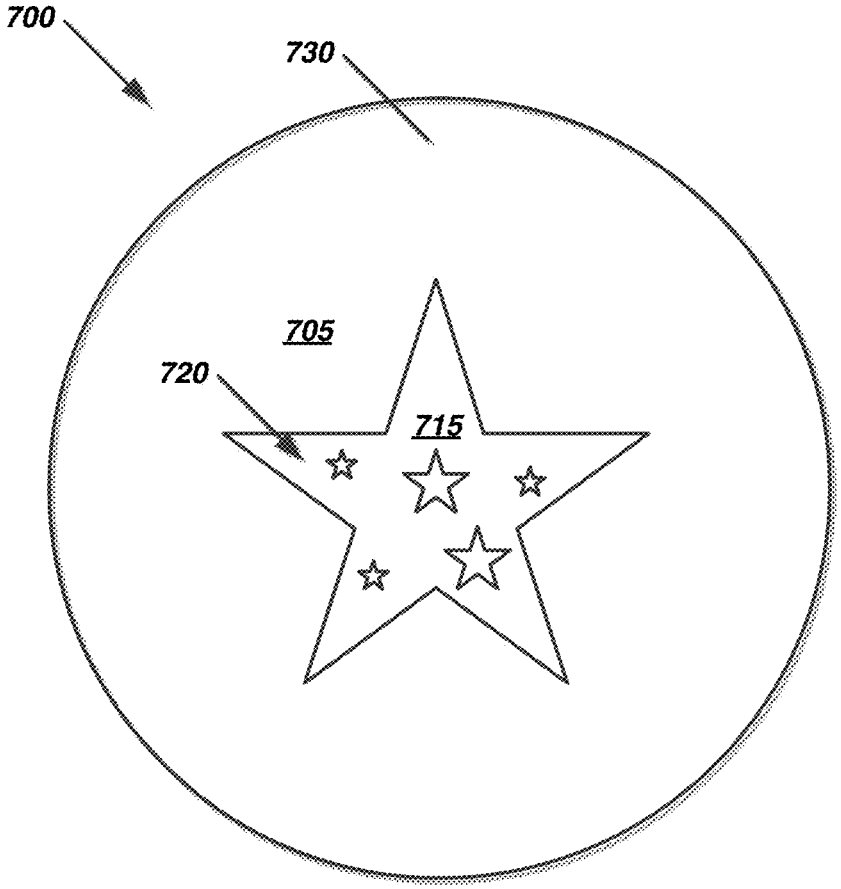
FIG. 7C is a front perspective view of the apparatus of FIGS. 7A-7B, illustrating a lens behind a decorative aperture.

FIGS. 7A and 7B collectively illustrate an example apparatus 700 that includes separate cover plate 705 and tubular collar 710 that can be releasably attached to one another. For example, the cover plate 705 can be threadably, compressively, or otherwise securable to the tubular collar 710. Because the cover plate 705 can be removed, the cover plate 705 can be replaced with a different cover plate that includes a different decorative shape. Advantageously, the selectively changeable nature of the cover plate 705 allows for end users to switch designs as desired. This change of design would be impossible using a stencil cutout that permanently alters the pumpkin with a single design. The apparatus 700 includes a light source 706 that is associated with a back surface of the cover body or plate 705. The light source is covered by the tubular collar 710. A cutting member 708 is associated with a terminal edge surface 712 of the tubular collar 710.

In some embodiments, the apparatus 700 can comprise a lens 715 that at least partially covers the decorative aperture 720 of the cover plate 705. The lens 715 can be partially opaque or transparent and can be positioned on a front surface 730 of the cover plate 705 or a back surface 735 of the cover plate 705. In some embodiments, the lens 715 can be disposed between the cover plate 705 and the tubular collar 710.

The lens 715 can be colored such that light emanating from inside the pumpkin can be filtered or changed in hue. In one embodiment, the lens 715 can be printed with an image that complements the decorative aperture 720. For example, in FIG. 7C, the lens 715 is printed with smaller stars 725 that are each colored. In another example, if the decorative aperture 720 is a cartoon character, a lens can be used that is a colored representation of the cartoon character. In another example, the decorative aperture 720 is a logo from a university and the lens can include the school colors for the university. These are all non-limiting examples of the device aperture and lens combinations.

Figure 8A:
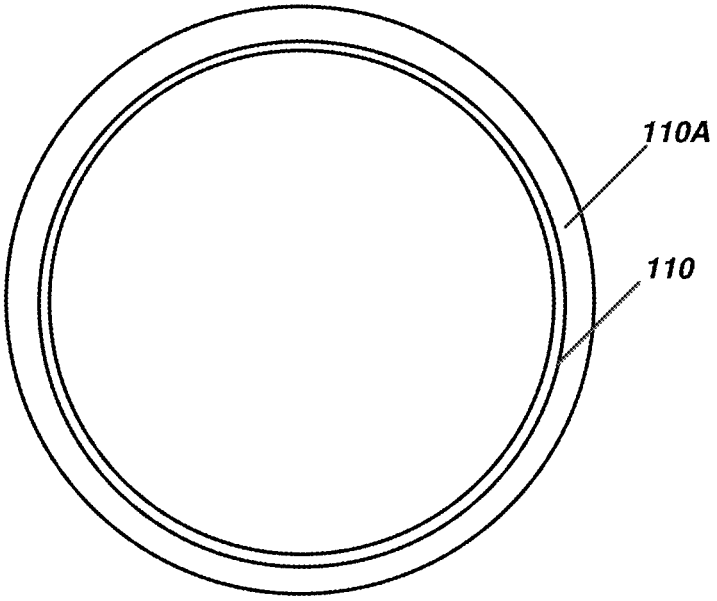
FIGS. 8A and 8B collectively illustrate an example device that comprises a flange that covers a cut edge of a pumpkin.
Figure 8B:
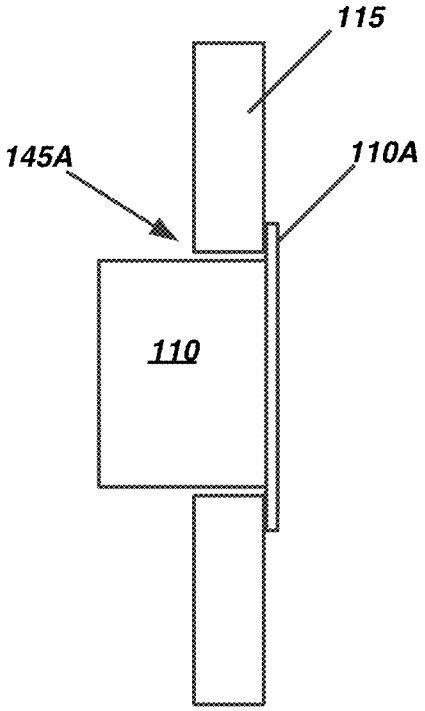

FIGS. 8A and 8B collectively illustrate an embodiment of a device that is constructed similarly to the device of FIGS. 1-6, with the exception that the tubular collar 110 comprises a flange 110A that extends outwardly and around a circumference of the body of the tubular collar 110. FIG. 8A is a rear perspective view of the tubular collar 110 and the flange 110A. Referring to FIG. 8B, the flange 110A is configured to overlap and/or cover an aperture 145 (e.g., hole) cut into the pumpkin 115. When the tubular collar 110 is inserted into the aperture 145, a slight gap 145A may be present between the tubular collar 110 and the aperture 145. This gap may be created by imperfections in the cut of the aperture 145.

In operation, a user will place the tubular collar 110 against an outer surface of a pumpkin or gourd. The user can transfer a marking onto the pumpkin or gourd by tracing a line around the outer peripheral edge of the tubular collar 110. The user can utilize a cutting tool such as a knife to cut through the pumpkin or gourd to create an aperture. The tubular collar 110 is inserted into the aperture and pushed into the pumpkin such that the flange 110A covers the cut edge of the aperture. The flange 110A is configured to cover the cut edge to prevent light from being emitted around the device 100.

In instances where the tubular collar 110 includes a cutting member (see FIG. 4) it may not be necessary to cut an initial aperture into the pumpkin or gourd.

While FIGS. 1-8B are described independently from one another, FIGS. 1-8B can also be referred to collectively for purposes of context and clarity of explanation. That is, a description of a particular figure may reference portions of other figures, either using explicit call outs to other figures or by the use of reference signals that are present in other figures. In some instances groups of figures may be referred to collectively. Also, it is contemplated that individual components of various embodiments can be combined together with other embodiments. For example, the flange of FIGS. 8A and 8B can be used in other embodiments, such as the embodiments of FIGS. 1, 4, 5, 6, 7A, and 7B.

While various embodiments have been described above, it should be understood that they have been presented by way of example only, and not limitation. The descriptions are not intended to limit the scope of the technology to the particular forms set forth herein. Thus, the breadth and scope of a preferred embodiment should not be limited by any of the above-described exemplary embodiments. It should be understood that the above description is illustrative and not restrictive. To the contrary, the present descriptions are intended to cover such alternatives, modifications, and equivalents as may be included within the spirit and scope of the technology as defined by the appended claims and otherwise appreciated by one of ordinary skill in the art. The scope of the technology should, therefore, be determined not with reference to the above description, but instead should be determined with reference to the appended claims along with their full scope of equivalents.

What is claimed is:

1. A device, comprising:

a light source configured to be disposed within a pumpkin, the light source being associated with a back surface of a cover body, the light source being covered by a tubular collar;

the cover body having a decorative aperture, wherein light generated by the light source is emitted uniformly-across an entirety of the decorative aperture, the decorative aperture being a patterned cutout in the cover body; and the tubular collar formed proximate an outer peripheral edge of the cover body, the tubular collar extending away from the cover body, the tubular collar having a terminal edge surface and a length that extends along a central axis of the cover body, wherein the tubular collar extends perpendicularly from the cover body and has a diameter that encircles an entirety of the decorative aperture of the cover body, further wherein an outer surface of the tubular collar contacts an inner sidewall of a hole cut in the pumpkin.

2. The device according to claim 1, further comprising a cutting member associated with the terminal edge surface.

3. The device according to claim 1, further comprising a colored lens that covers at least a portion of the decorative aperture.

4. The device according to claim 3, wherein the tubular collar is releasably connected to the cover body.

5. The device according to claim 4, wherein the colored lens is disposed between the cover body and the tubular collar.

6. The device according to claim 1, wherein the tubular collar comprises a candle holder.

* * * * *